US006321815B1

(12) United States Patent
You

(10) Patent No.: US 6,321,815 B1
(45) Date of Patent: Nov. 27, 2001

(54) PROTECTOR FOR LEADING END OF CORRECTION TAPE

(76) Inventor: Kwang-Ho You, 103-1102 Hyundae Apartment, 1037 Mansu-dong Namdong-ku, Inchun-shi (KR)

( * ) Notice: Subject to any disclaimer, the term of this patent is extended or adjusted under 35 U.S.C. 154(b) by 0 days.

(21) Appl. No.: 09/405,682

(22) Filed: Sep. 24, 1999

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 523, 156/257, 527, 540, 574, 577, 579; 118/76, 200; 225/46; 242/160.2, 160.4, 170, 171, 588, 588.2, 588.3, 588.6

(56) References Cited

U.S. PATENT DOCUMENTS 5,679,156 * 10/1997 Matsumaru ..... 156/577 X
6,059,002 * 5/2000 Katami ..... 156/541

* cited by examiner

*Primary Examiner*—Mark A. Osele

(74) *Attorney, Agent, or Firm*—Anderson, Kill & Olick, P.C.

(57) ABSTRACT

A correction tape leading end protector installed in a correction tape roller device is provided. According to conventional art, the whole main body should be moved in order to protect the leading end of the correction tape, which needs much force and is difficult to handle it with one finger. The protector which is installed in a correction tape roller device includes a guide groove which is formed lengthwise along both the sides near the end of the tape guide, guide protrusions which are installed in parallel and spaced by a predetermined distance near the end of the tape guide, for preventing the correction tape from being beyond a predetermined path, and a moving cap surrounding the guide protrusions to protect the correction tape passing between the guide protrusions, and installed to be moved by a predetermined distance along the guide groove to cover the leading end of the correction tape as necessary. Thus, the moving cap can be moved with a less force, that is, even with only a finger, in order to cover the leading end of the externally exposed correction tape. This enables a convenient use. Further, since the protector is installed in the end of the tape guide, the present invention can be easily applied to any type of a correction tape roller device in which the end of the tape guide is externally exposed.

4 Claims, 9 Drawing Sheets

PROTECTOR FOR LEADING END OF CORRECTION TAPE

BACKGROUND OF THE INVENTION

1. Field of the Invention

The present invention relates to a protector for the leading end of correction tape for use in a correction tape roller device, and more particularly, to a protector which is installed in a correction tape roller device, for protecting the externally exposed leading end of correction tape.

2. Description of the Prior Art

A general correction tape roller device includes a main body in which rollers are rotatably installed, a roll of correction material coated tape wound on the rollers, a case for accommodating and supporting the main body, and a tape guide which is installed in the end of the main body, for guiding movement of the correction tape to the outside of the case. In this connection, a conventional correction tape roller device will be described with reference to FIGS. 1 and 2.

FIG. 1 is a perspective view showing one example of a conventional correction tape roller device. FIG. 2 is a perspective view showing the state where the main body of FIG. 1 has been retreated.

Referring to FIGS. 1 and 2, a correction tape roller device 100 includes a main body 110 which can be moved back and forth. A roller around which correction tape is wound, and another roller around which the used correction tape is collected, are installed in the main body 110. Also, on the main body 110 are formed a protrusion 111 for easily moving the main body 110 and a stopper 112 for locating the main body 110 to stop in its place.

A tape guide 120 for guiding the correction tape 10 is installed in the end of the main body 110, in which a part of the end of the tape guide 120 protrudes outward from the main body 110 to allow the correction tape 10 to be pressed on paper in order to correct typographical errors.

A case 130 accommodates the main body 110 and the tape guide 120 to protect them from being damaged. On the upper surface of the case 130 is formed openings 131 for exposing the protrusion 111 and the stopper 112, respectively. In the front end of the case 130 is formed a first opening 132 through which the tape guide 120 protrudes. In the back end of the case 130 is formed a second opening 133 for inserting the main body 110.

That is to say, as shown in FIG. 1, in the case that typographical errors are to be corrected, the end of the tape guide 120 is made to protrude outwards from the first opening 132, and the leading end of the correction tape 10 passing through the end of the tape guide 120 is pressed and moved over a corresponding portion on paper, to thereby coat a correction material on the paper to correct the typographical errors.

In the case that the correction tape roller device is kept separately after correcting the typographical errors, the protrusion 111 is pressed and slidably pulled backwards. Then, as shown in FIG. 2, the main body 110 and the tape guide 120 installed in the end of the main body 110 are moved backwards, so that the tape guide 120 enters the inside of the case 130. That is, since the leading end of the correction tape 10 is hidden in the inside of the case 130 and protected from being damaged, the correction material of the correction tape 10 is not peeled out and foreign matter is not attached to the correction material thereof.

In the case of the correction tape roller device 100 as shown in FIGS. 1 and 2, the whole main body 110 should be moved in order to protect the externally exposed correction tape 10. As a result, much effort is made to protect the exposed correction tape. Both hands are used to move the main body 110 since it is difficult to move it with only one hand.

SUMMARY OF THE INVENTION

To solve the above problems, it is an object of the present invention to provide a protector which is installed in a correction tape roller device which includes a main body containing a roller around which a correction material coated tape is wound and another roller around which the used correction tape is collected, a case for accommodating and supporting the main body, and a tape guide which is installed in the end of the main body, for guiding movement of the correction tape to the outside of the case, thereby protecting the externally exposed leading end of the correction tape passing through the end of the tape guide.

To accomplish the above object of the present invention, there is provided a protector which is installed in a correction tape roller device which includes a main body containing rollers around which a correction tape is wound, a case for accommodating and supporting the main body, and a tape guide which is installed in the end of the main body, for guiding movement of the correction tape to the outside of the case, to thereby protect the externally exposed leading end of the correction tape, the correction tape leading end protector comprising: a guide groove which is formed lengthwise along both the sides near the end of the tape guide; guide protrusions which are installed in parallel and spaced by a predetermined distance near the end of the tape guide, for preventing the correction tape from being beyond a predetermined path; and a moving cap surrounding the guide protrusions to protect the correction tape passing between the guide protrusions, and installed to be moved by a predetermined distance along the guide groove to cover the leading end of the correction tape as necessary.

Preferably, the guide groove is formed of a T-shaped groove in either side of the tape guide, and the guide protrusions are formed protrudingly upward along the guide groove. It is further preferable that the moving cap comprises a combining protrusion which is combined with the guide groove; a combining portion surrounding the guide protrusion; an extension portion which is extended forward from the combining portion, to cover the leading end of the correction tape as necessary; and a pressing protrusion which is protrudingly installed on the surface of the extension portion or the combining portion, to thereby allow the moving cap to be easily pushed or pulled with a finger.

BRIEF DESCRIPTION OF THE DRAWINGS

The object and other advantages of the present invention will become more apparent by describing in detail the structures and operations of the present invention with reference to the accompanying drawings, in which.

DETAILED DESCRIPTION OF THE INVENTION

Preferred embodiments of the present invention will be described in detail with reference to the accompanying drawings.

Figure 1:
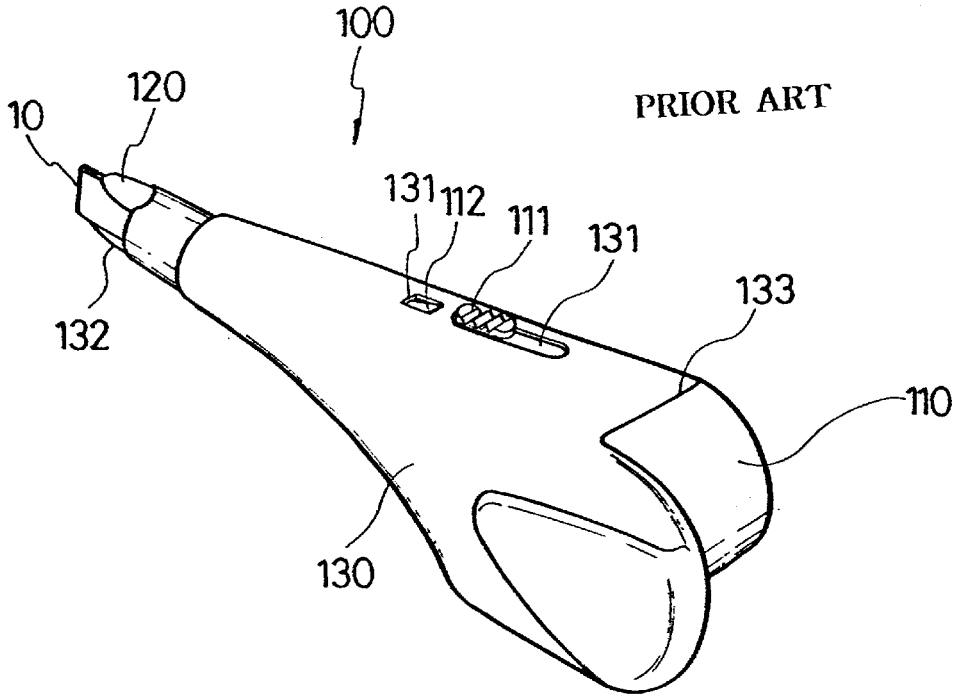
FIG. 1 is a perspective view showing one example of a conventional correction tape roller device.
Figure 2:
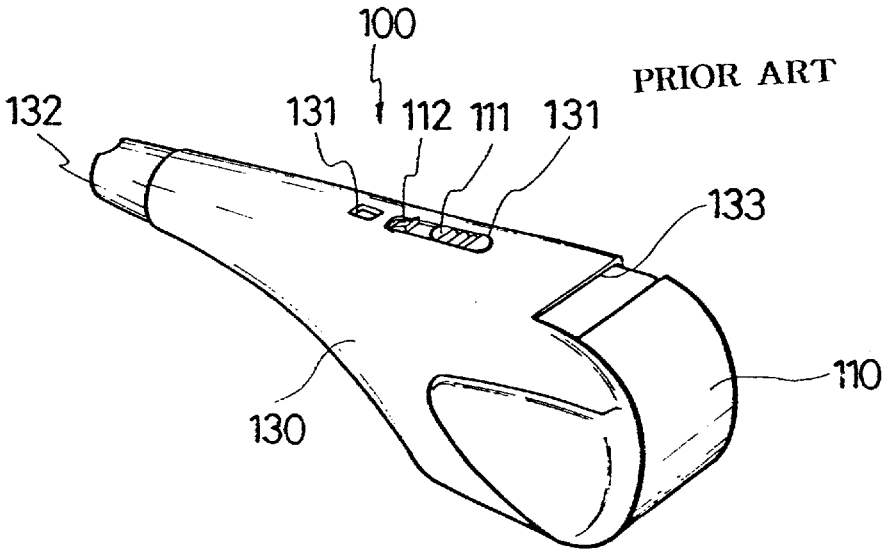
FIG. 2 is a perspective view showing the state where a main body of FIG. 1 has been retreated.
Figure 3:
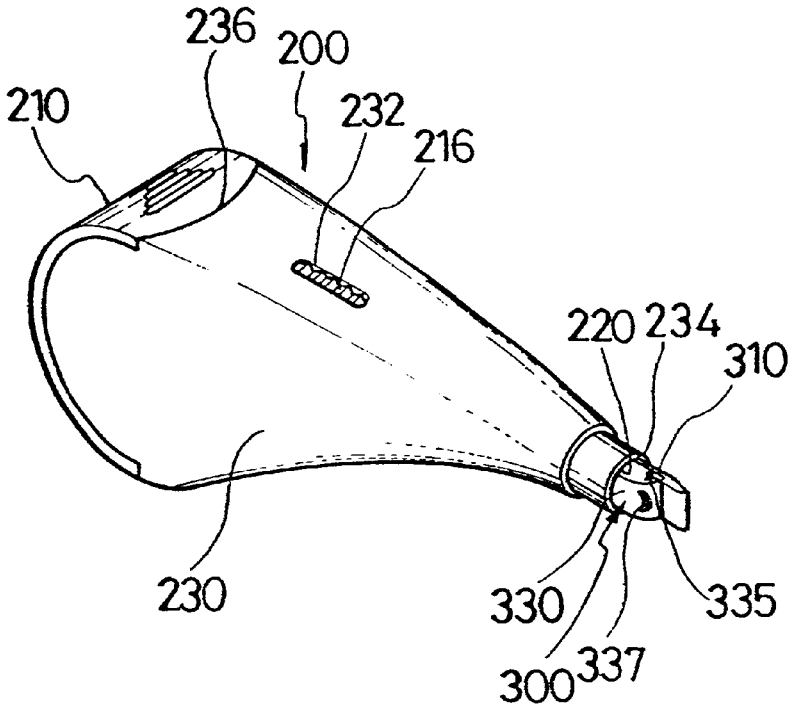
FIG. 3 is a perspective view of a correction tape roller device in which a protector for protecting the leading end of a correction tape according to the present invention is installed.
Figure 4:
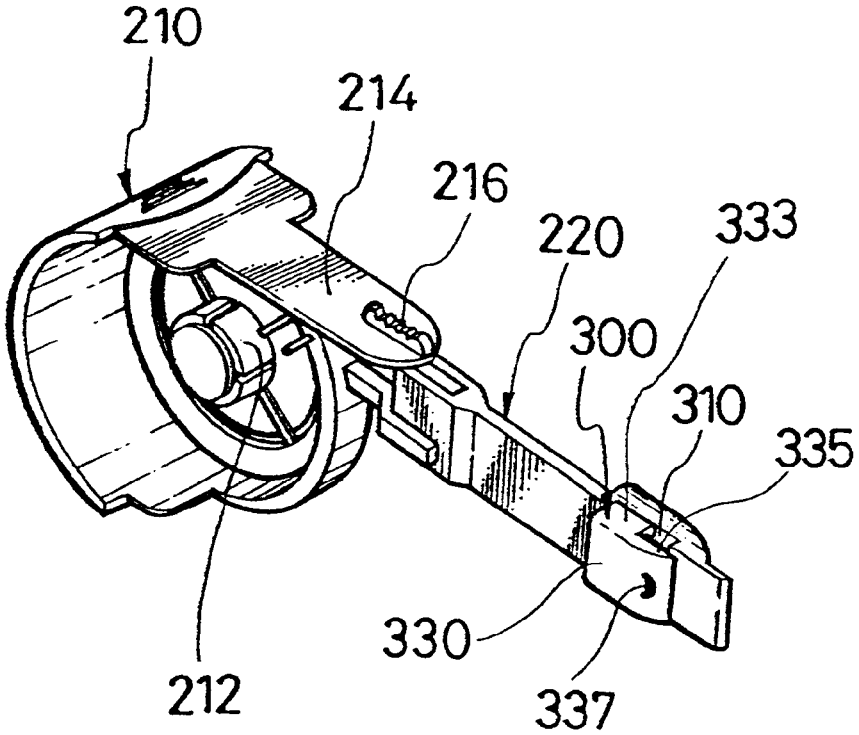
FIG. 4 is a perspective view showing the state where a main body and a tape guide are combined.

As shown in FIGS. 3 through 4, a correction tape roller device 200 according to the present invention includes a main body 210, a tape guide 220 installed in the main body 210, and a case 230. A protector 300 for protecting the leading end of a correction tape is installed in the end of the tape guide 220.

As can be seen from FIG. 4, a roller 212 around which a correction tape 10 is wound is installed in the main body 210. An engaging protrusion 216 is formed in an elastic arm 214 located in the upper portion of the main body 210.

The tape guide 220 is combined with the main body 210. The tape guide 220 is detachably installed in the leading end of the main body 210, for guiding the correction tape 10 to the outside of the main body 210 and pressing the correction tape 10 over a necessary portion on paper. In the end of the tape guide 220 is formed a protector for protecting the leading end of the correction tape according to the present invention. The correction tape leading end protector 300 protects the leading end of the externally exposed correction tape 10, as necessary, which will be described in more detail with reference to FIGS. 5 through 8.

The case 230 accommodates the main body 210 and the tape guide 220 and protects them from being damaged. A stopper opening 232 is formed on the upper surface of the case 230. Also, a first opening 234 is formed in the front surface of the case 230 so that the end of the tape guide 220 protrudes, and a second opening 236 is formed on the rear surface thereof so that the main body 210 can be easily detached.

Here, the tape guide 220 can be integrally formed in the main body 210. In addition, the correction tape leading end protector 300 according to the present invention can be applied to various types of correction tape roller devices in which the end of the tape guide 220 protrudes outwards.

Figure 5:
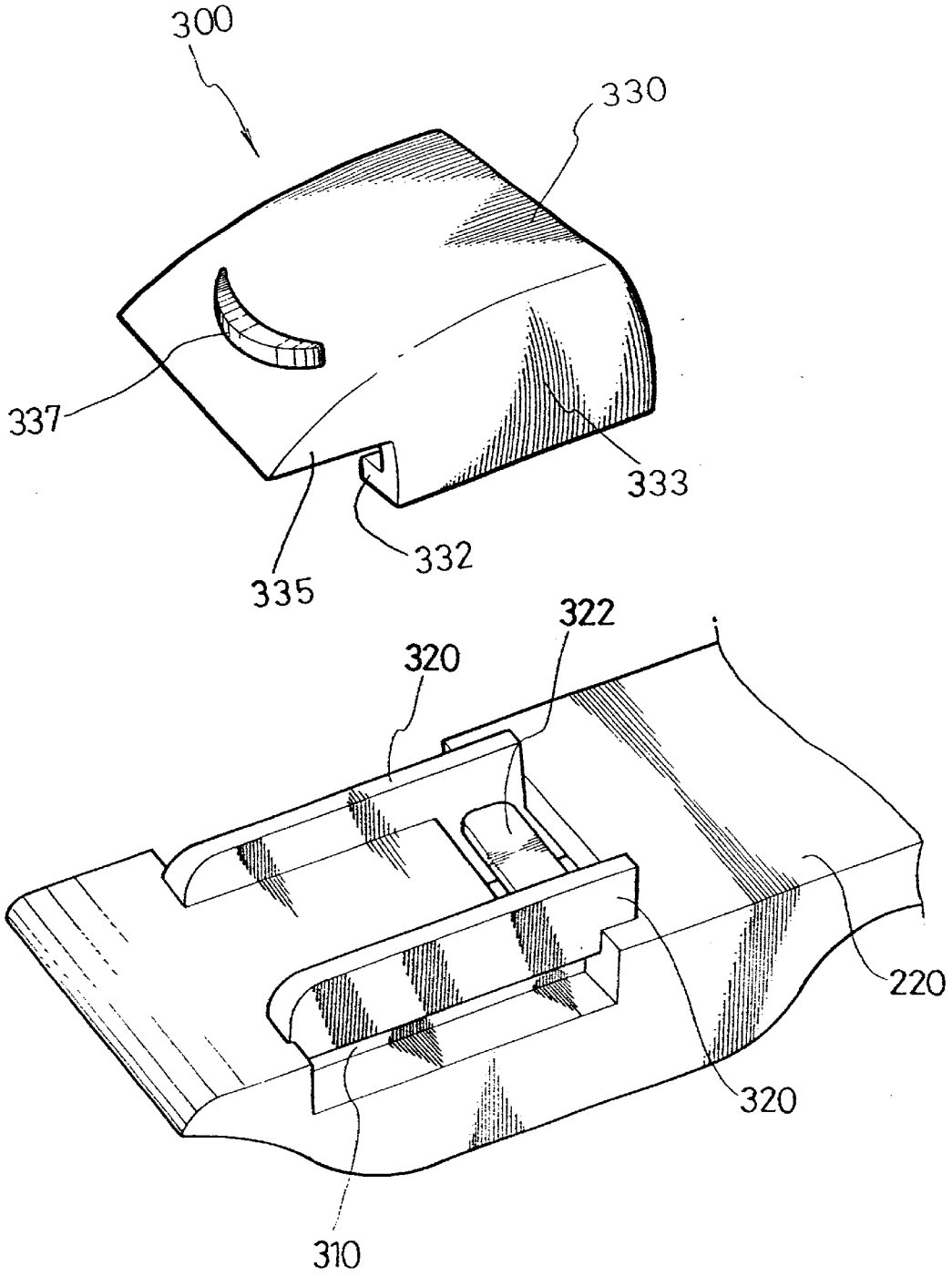
FIG. 5 is a separate perspective view showing the correction tape leading end protector according to the present invention.
Figure 6:
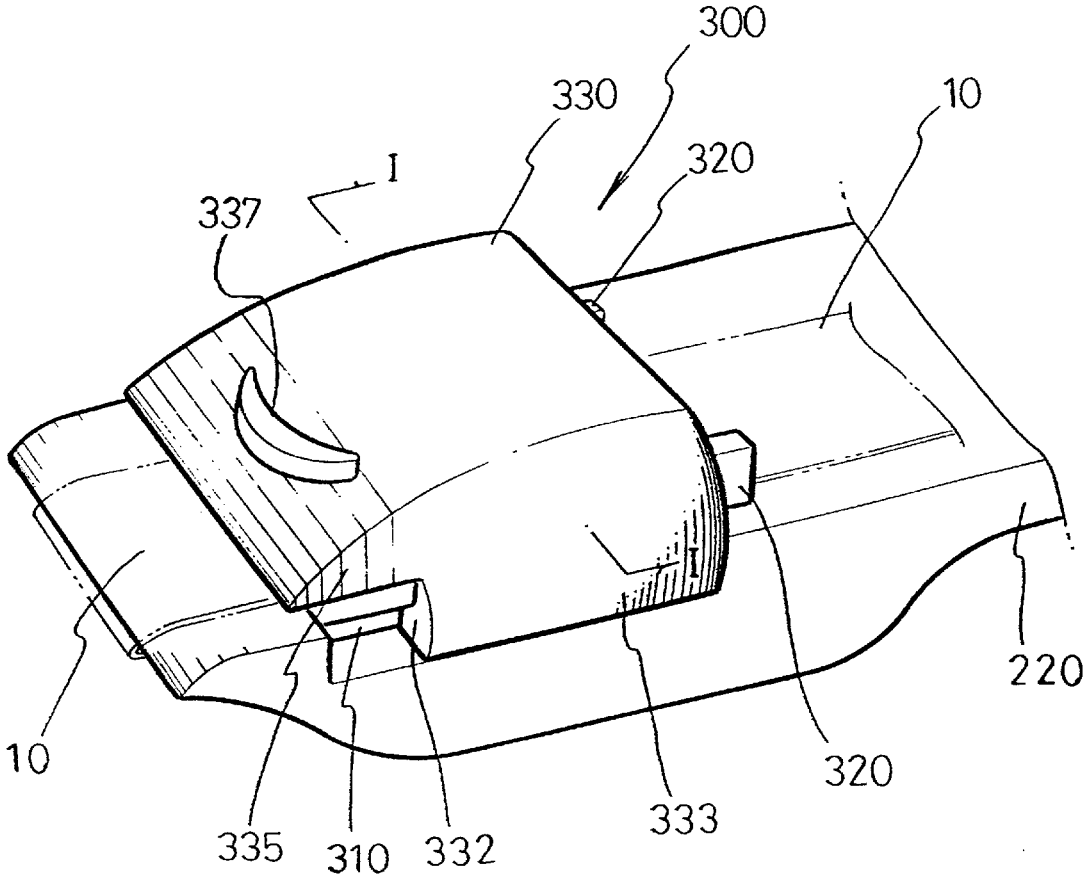
FIG. 6 is a perspective view showing the state where the installed moving cap has been retreated.
Figure 7:
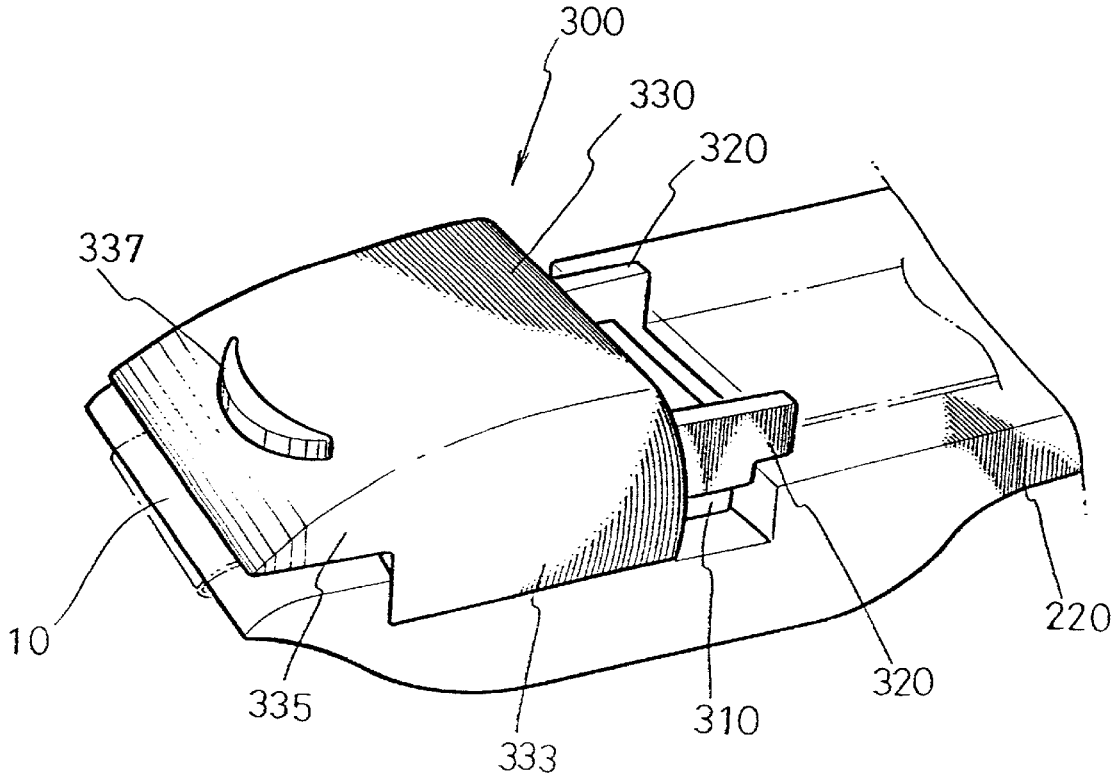
FIG. 7 is a perspective view showing the state where the installed moving cap has been advanced.
Figure 8:
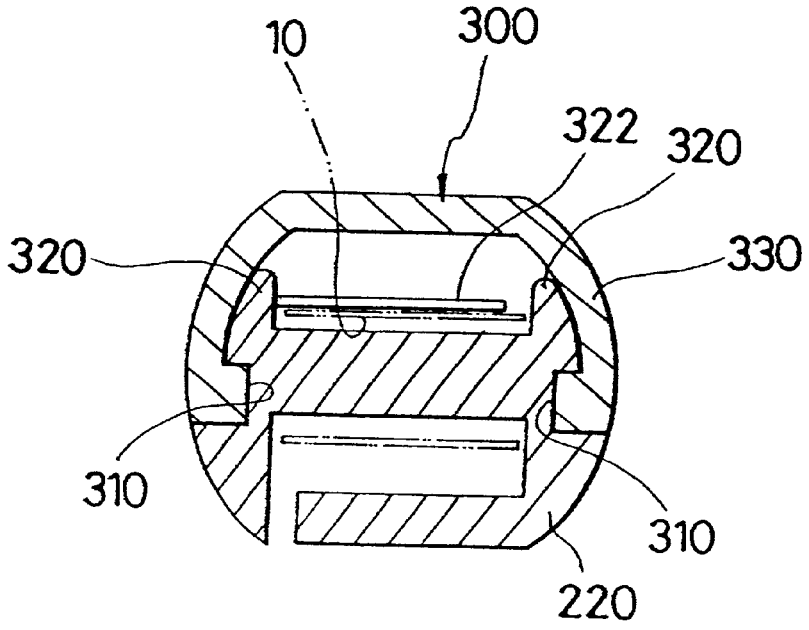
FIG. 8 is a sectional view along a line I—I of FIG. 6.

FIG. 5 is a separate perspective view showing the correction tape leading end protector according to the present invention. FIG. 6 is a perspective view showing the state where the installed moving cap has been retreated. FIG. 7 is a perspective view showing the state where the installed moving cap has been advanced. FIG. 8 is a sectional view along a line I—I of FIG. 6.

As shown in FIGS. 5 through 8, the correction tape leading end protector 300 according to the present invention includes a guide groove 310. The guide grooves 310 are formed lengthwise along both side surfaces near the end of the tape guide 220. T-shaped grooves are formed in both side surfaces of the tape guide 220 as the guide grooves 310. As being the case, the guide grooves 310 can be formed of various types of structures. It is sufficient to have a structure of guiding movement of the moving cap 330.

As shown, a pair of guide protrusions 320 are installed above the guide grooves 310 in parallel with each other and spaced by a predetermined distance. The guide protrusions 320 are installed near the end of the tape guide 220, to prevent the correction tape 10 from being beyond a predetermined path. On the inner side surface of the guide protrusion 320 is installed a secession prevention sill 322 which protrudes toward the other side surface for preventing the correction tape 10 form being swerved upwards, which is not however essential. The guide protrusion 320 is preferably formed so that the former protrudes upwards along the guide grooves 310.

The correction tape leading end protector 300 according to the present invention includes the moving cap 330. The moving cap 330 encloses the guide protrusions 320 to protect the correction tape 10 passing between the guide grooves 320 from being damaged. Also, as it being the case, the moving cap is moved to a necessary position, to cover the leading end of the correction tape 10, and installed movably along the guide grooves 310.

As shown, the moving cap 330 includes a combining protrusion 332 which is combined with the guide grooves 310, a combining portion 333 enclosing the guide protrusions 320, an extension portion 335 which is extended forward from the combining portion 333 so that the leading end of the correction tape 10 can be covered as necessary, and a pressing protrusion 337 which is protrudingly installed on the surface of the extension portion 335, to thereby allow a user to push or pull the moving cap 330 easily with his or her finger. The pressing protrusion 337 can be formed on the surface of the combining portion 333 as it being the case. The state where the moving cap 330 has been combined with the guide grooves 310 can be seen in detail from FIG. 8.

In other words, when typographical errors on paper are corrected using the correction tape roller device 200 in which the correction tape leading end protector 300 according to the present invention has been installed, the pressing protrusion 337 is pressed by finger and retreated backwards. Also, after performing a correction work, the pressing protrusion 337 is pressed by finger and moved forwards, to thereby cover the leading end of the correction tape 10 which is exposed outwards, and then keep it in custody. By so doing, foreign matters do not cling to the correction material of the correction tape and the correction tape 10 contacts various types of objects to accordingly secede the correction material therefrom. Through these procedures, the moving cap 330 is so small that less effort is made to move the correction tape, which can be moved even with a finger.

Figure 9:
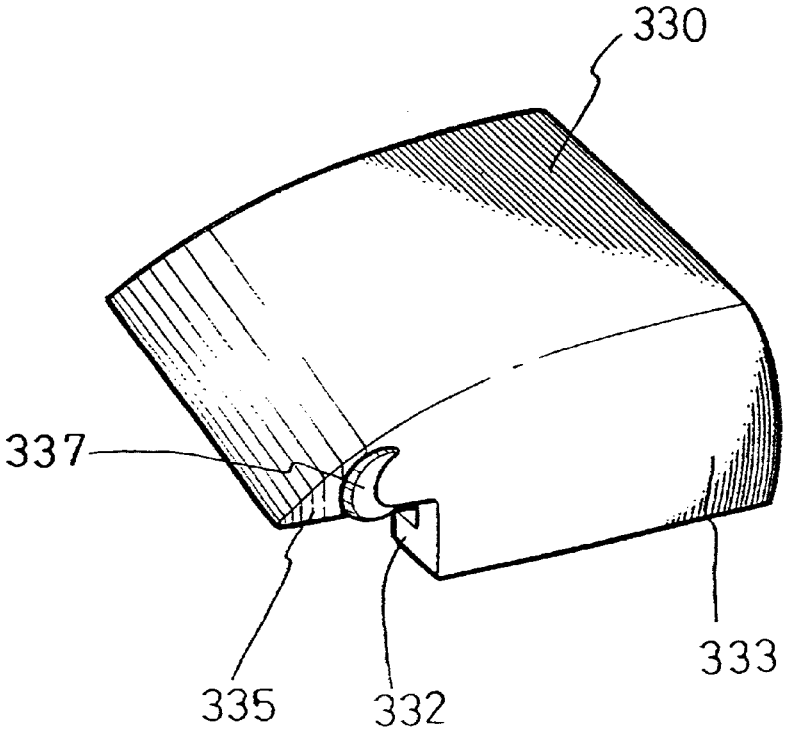
FIG. 9 is a perspective view showing another example of the moving cap.

FIG. 9 is a perspective view showing another example of the moving cap. As shown in FIG. 9, the pressing protrusion 337 can be formed on the lateral surface of the extension portion of the moving cap 330 as it being the case. Besides, the combining protrusion 332, the combining portion 333 and the extension portion 335 which are shown in FIG. 8 are the same as the above-described elements, whose explanation is accordingly omitted.

As described above, when the correction tape leading end protector according to the present invention is adopted in the correction tape roller device, the moving cap can be moved with a less force, that is, even with only a finger, in order to cover the leading end of the externally exposed correction tape. This enables a convenient use. Further, since the protector is installed in the end of the tape guide, the present invention can be easily applied to any type of a correction tape roller device in which the end of the tape guide is externally exposed.

What is claimed is:

1. A protector which is installed in a correction tape roller device which includes a main body containing rollers around which a correction tape is wound, a case for accommodating and supporting the main body, and a tape guide which is installed in the end of the main body, for guiding movement of the correction tape to the outside of the case, to thereby protect the externally exposed leading end of the correction tape, the correction tape leading end protector comprising:

a guide groove which is formed lengthwise along both the sides near the end of the tape guide;

guide protrusions which are installed in parallel and spaced by a predetermined distance near the end of the tape guide, for preventing the correction tape from being beyond a predetermined path; and a moving cap surrounding the guide protrusions to protect the correction tape passing between the guide protrusions, and installed to be moved by a predetermined distance along the guide groove to cover the leading end of the correction tape as necessary.

2. The correction tape leading protector according to claim 1, wherein said guide groove is formed of a T-shaped groove in either side of the tape guide, and the guide protrusions are formed protrudingly upward along the guide groove.

3. The correction tape leading protector according to claim 1, wherein said moving cap comprises a combining protrusion which is combined with the guide groove; a combining portion surrounding the guide protrusion; an extension portion which is extended forward from the combining portion, to cover the leading end of the correction tape as necessary; and a pressing protrusion which is protrudingly installed on the surface of the extension portion or the combining portion, to thereby allow the moving cap to be easily pushed or pulled with a finger.

4. The correction tape leading protector according to claim 2, wherein said moving cap comprises a combining protrusion which is combined with the guide groove; a combining portion surrounding the guide protrusion; an extension portion which is extended forward from the combining portion, to cover the leading end of the correction tape as necessary; and a pressing protrusion which is protrudingly installed on the surface of the extension portion or the combining portion, to thereby allow the moving cap to be easily pushed or pulled with a finger.

* * * * *